US009873977B2

(12) United States Patent
Farnsworth

(10) Patent No.: US 9,873,977 B2
(45) Date of Patent: Jan. 23, 2018

(54) SOCK TIE APPARATUS AND METHOD

(71) Applicant: Carole Farnsworth, Woods Cross, UT (US)

(72) Inventor: Rodney Farnsworth, Woods Cross, UT (US)

(73) Assignee: Carole Farnsworth, Woods Cross, UT (US)

( * ) Notice: Subject to any disclaimer, the term of this patent is extended or adjusted under 35 U.S.C. 154(b) by 0 days.

(21) Appl. No.: 15/068,957

(22) Filed: Mar. 14, 2016

(65) Prior Publication Data

US 2017/0260686 A1 Sep. 14, 2017

(51) Int. Cl.
*D06F 95/00* (2006.01)

(52) U.S. Cl.
CPC ..... *D06F 95/008* (2013.01)

(58) Field of Classification Search
CPC ..... D06F 95/008
See application file for complete search history.

(56) References Cited

U.S. PATENT DOCUMENTS

| | | | | | |
|---|---|---|---|---|---|
| 3,346,927 | A * | 10/1967 | Tompkins | A47K 10/12 | 24/464 |
| 3,606,651 | A * | 9/1971 | Goodman | A44B 99/00 | 24/484 |
| 3,673,639 | A * | 7/1972 | Driscoll | A44B 99/00 | 24/16 PB |
| 3,688,348 | A | 9/1972 | Klotz et al. | | |
| 3,900,181 | A | 8/1975 | Pitanis | | |
| 5,321,855 | A | 6/1994 | Ciuffo | | |
| 5,381,588 | A * | 1/1995 | Nelson | B65D 73/0064 | 24/30.5 S |
| 5,671,876 | A | 9/1997 | Gardner | | |
| 5,944,236 | A | 8/1999 | Cinque | | |
| 6,161,263 | A * | 12/2000 | Anderson | A41B 11/002 | 24/30.5 S |
| 6,588,633 | B1 * | 7/2003 | Ammann | D06F 95/008 | 223/85 |
| 6,760,943 | B2 | 7/2004 | Williams | | |
| 7,225,507 | B2 | 6/2007 | Anderson et al. | | |
| 2004/0154075 | A1 * | 8/2004 | Ferguson | D06F 95/008 | 2/239 |

(Continued)

FOREIGN PATENT DOCUMENTS

| | | | |
|---|---|---|---|
| DE | 102005015009 | A1 | 5/2006 |
| WO | WO 1996010345 | A2 | 4/1996 |
| WO | WO 2006095370 | A1 | 9/2006 |

*Primary Examiner* — Robert Sandy
*Assistant Examiner* — David M Upchurch
(74) *Attorney, Agent, or Firm* — Pate Baird, PLLC

(57) ABSTRACT

A sock tie is used when laundering socks, in order to keep a pair together. Formed of a comparatively high temperature polymer, the elastomeric loop may be drawn around a pair of socks one or more times to bind them together. The tension in the loop need not be excessively high. The nearer to the center of the length of a pair of socks the loop is placed, the less tension is required, inasmuch as the socks themselves by their random motion will resist self removal of the band or loop. Logos, labels, text, instructions, images, colors and the like may be formed into tabs attached at one or more points about the circumference of a sock tie loop. The tab provides an ease of removal while also providing space for advertising, logos, instructions, or the like.

10 Claims, 7 Drawing Sheets

(56) References Cited

U.S. PATENT DOCUMENTS

| | | | | |
|---|---|---|---|---|
| 2008/0244877 | A1* | 10/2008 | Sell | D06F 95/008 24/306 |
| 2008/0256763 | A1* | 10/2008 | Azzopardi | A47G 25/48 24/343 |
| 2008/0276433 | A1* | 11/2008 | Yacov | D06F 5/008 24/16 R |
| 2012/0103029 | A1* | 5/2012 | Darwin | A47G 25/28 68/235 R |
| 2014/0304895 | A1 | 10/2014 | Stuart | |
| 2016/0047084 | A1* | 2/2016 | Biller | D06F 95/008 24/532 |

* cited by examiner

SOCK TIE APPARATUS AND METHOD

BACKGROUND

1. Field of the Invention

This invention relates to laundry accessories and, more particularly, to novel systems, methods, and tools to keep socks matched during laundering.

2. Background Art

Laundry is a perennial activity in most households. Also, socks are historically difficult match. This is not simply because they sometimes look somewhat alike, but a greater problem. Typically, socks are a comparatively small article of clothing. They are often colored, sometimes is not. They often contain synthetic fabrics such as nylon, polyester, spandex, other elastic, and so forth. These and even natural fibers, such as wool, often generate static cling. This puts socks in the position of being captured by other articles placed in the laundry load with socks, whether "whites" or "colors."

In colors will be found shirts, towels, and other comparatively larger objects. In whites may be found linens, towels, underclothing, and so forth. Static buildup during the drying process may cause small articles of clothing to cling to other articles, and not separate.

For example, towels or t-shirts may be withdrawn from a tumbling dryer and put in another basket for, or as part of, sorting. It is completely within the realm of contemplation that a towel may be folded with a sock clinging to the backside. Thus, the sock is not seen, does not produce a noticeable bulge, and is not found until the towel is removed from a linen closet for use.

Thus, by such modes and many others, socks may become separated from one another, and such as been the case forever. Unmatched socks are the bane of the laundry function in any household. Moreover, some socks are apparently never found. A lone sock may sit in a drawer waiting a mate for months or years. Thus, there exist common jokes about how gremlins reach into the washing process and remove one out of every two socks in a pair. Of course this is not true. However, such jokes illustrate the ubiquitous nature and severity of the frustration from the problem.

Thus, it would be an advance in the art to find a simple system and mechanism for binding two socks of a pair together reliably and releasing them readily on demand. It would be an advance in the art if this system and mechanism could function equally well in a wash cycle and a drying cycle. For example, dryers operate at comparatively very high temperatures over 250 degrees Fahrenheit (115 degrees C.) in order to vaporize water to evaporate out of the fabric of clothing being dried.

Meanwhile, agitation, detergents, and the water are problematic for metals. Thus, resistance to chemical attack, corrosion, and the like may be important for protection of the system and device. This may also be a concern so that socks are not stained by rust or other oxidation of metals.

BRIEF SUMMARY OF THE INVENTION

In view of the foregoing, in accordance with the invention as embodied and broadly described herein, a method and apparatus are disclosed in one embodiment of the present invention as including the manufacture and use of a loop or apparatus having elastic properties. Here, the word "elastic" is used in the engineering sense. That is, elastic deflection or deformation is fully recoverable upon release of applied force or stress.

For example, a steel spring, certain types of polymeric materials, and the like may be stretched or compressed. Their stretch (elongation, strain) is proportional to the force or stress (weight, force, force per unit area) in an effectively linear relationship according to Hooke's Law. Hooke's Law states that force is equal to a constant characterizinag the material and its configuration, multiplied by the deflection. Of course, this is a linear relationship wherein deflection is proportional to force directly through the spring constant.

The apparatus may take on various configurations. For example, its cross section may vary from one sided (circular) to two sided (an elongate cross section terminating at each extremum at a comparatively zero distance), to three sided (triangular). Moreover, a four sided device (square, parallelogram, rhombus, rectangle, trapezoid, etc.), or the like is within contemplation. Moreover, five, six, eight, or some other number of sides may be considered.

The aspect ratio of thickness to width may vary. For example, a right circular cylinder may be one cross sectional representation of a segment of an apparatus. On the other hand, an oval cross section, a figure eight cross section, an ellipse, or the like may likewise be tractable. In fact, the cross sectional area and the cross sectional shape may be produced by extrusion, injection molding, or other process to be made in any number of shapes.

The band may also be extruded as a closed loop of any shape, and then sliced to form closed, narrow bands with their own cross sections representing the opening within the elastic apparatus.

The wall of such a band or apparatus may be of a thickness, length, and width to suit a user and supportable manufacturing processes. Also, the wall thickness will necessarily affect the stiffness or the spring constant governing performance of the apparatus. In some embodiments, the thickness may be comparatively smaller, with an inside diameter comparatively larger for the overall loop. Thus, the apparatus may stretch a greater or lesser distance. Material and dimensions may change how far it will stretch.

For example, a thicker wall will typically require more force to stretch the opening. A thinner wall will be easier to stretch. Likewise, the particular maximum deflection permissible in a specific elastomeric polymer may depend on its cross linking and its particular principal chemistry. Accordingly, some materials may stretch a mere ten to twenty percent of their initial circumference. Other materials may stretch literally one thousand percent of their initial circumference. Thus, maximum permissible deflection may be affected, as well as the stiffness or spring constant of the material itself or of a thicker or thinner cross section thereof.

This leads to the fact that a loop or apparatus in accordance with the invention may be used in a single pull and a single wrap around a pair of socks. In other embodiments, the loop may be sufficiently flexible, and have sufficient elongation that a loop may be placed around a pair of socks, twisted and then looped back over the pair again to provide two loops or two encircling of the pair of socks to bind them together.

Also, in certain embodiments, a tab or grip may be provided in one region of an apparatus. The loop, for example, may have a tab that extends radially outward. In other embodiments, the tab may actually extend axially upward or downward perpendicular to the plane representing the top and bottom surface of such a loop. In this way, fingers may obtain a good grip to place a loop on, or remove a loop from the socks.

The tab is perhaps more important after washing and drying of the socks. At this time, the socks may be fluffed up to their highest bulk. A tight constriction of the loop about the socks may render difficult placing a finger inside the loop or inside one turn of the loop in order to remove it from the socks. Thus, the tab provides a grip.

In certain embodiments, the grip is disposed in a particular shape, and may be provided in particular colors or shapes to indicate a logo, a message, a theme, a set, owner-selectable distinction, or the like. Likewise, words, such as instructions or other text, an image, or a logo may be built into the grip or tab used for handling, especially removal, of the apparatus.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
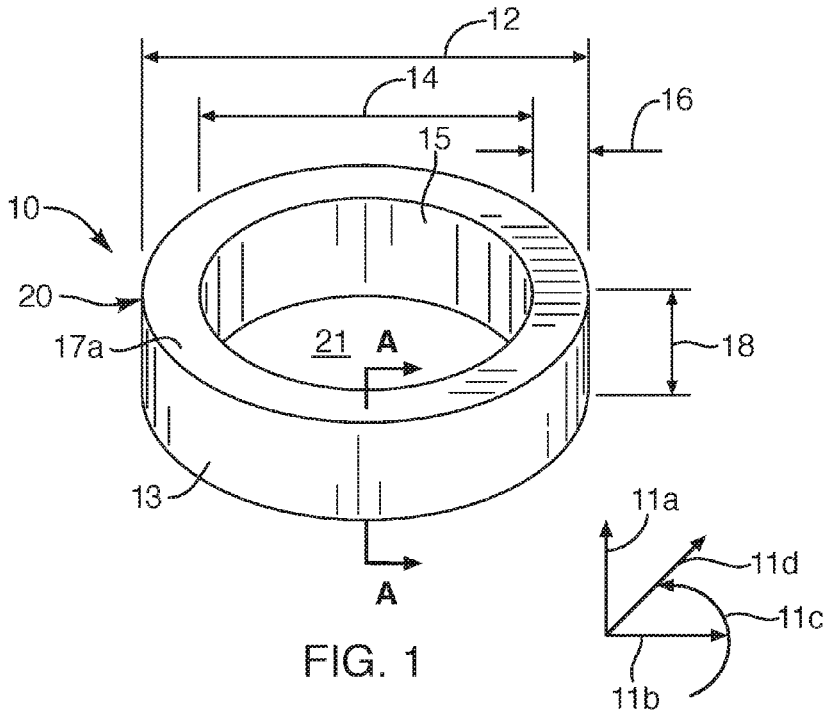
FIG. 1 is a perspective view of one embodiment of an apparatus in accordance with the invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1 through 9, while referring generally to FIGS. 1 through 15, an apparatus 10 or loop 10 in accordance with the invention may be formed of a polymer, typically an elastomeric polymer having a suitable flexibility, spring constant, cross sectional area, and other dimensions to operate as an elastic band 10. Typically, an apparatus 10 will be characterized by an outside diameter 12 or effective outside diameter 12.

By effective diameter is meant the hydraulic diameter as understood in the engineering arts. A hydraulic diameter is four times the area enclosed divided by the wetted perimeter or the enclosed perimeter. Thus, a circle devolves to an actual physical diameter. An effective diameter or hydraulic diameter of a square is simply the length of one side.

Any other shape has a value of hydraulic diameter by the same relationship, which will be something calculated only because it may not actually exist anywhere. Slits and slots sometimes degenerate to simply the distance across the smaller dimension. Nevertheless, an effective diameter 12 may be calculated for any shape.

For example, the actual shape of the loop 10 or apparatus 10 may be any shape desired. For example, the shape of the outside diameter 12 is actually the outer surface 13 or defined by the outer surface 13. Similarly, the inside diameter 14, which is actually the effective internal diameter 14, may be calculated according to the rules of hydraulic diameter. Likewise, the inner surface 15 describes or defines the actual perimeter giving rise to the effective inside diameter 14. Accordingly, the thickness 16 need not be uniform. However, it has been found that a uniform thickness 16 is often the best to serve the need for a comparatively uniform deflection or strain.

Strain is actually a dimensionless deflection or stretch. By stretch is meant deflection in either direction, compression or tension. Thus, deflection is the general term, while stretch represents elongation under tensile load. Compression or shrinkage represents deflection under compressive load. The point here is that strain is a dimensionless number meaning the distance of deflection divided by the overall length dimension.

For example, a circle may have an amount of strain constituting a number of inches per inch of length of circumference or the number of centimeters per centimeter of overall length. Thus, it is proper to speak of deflection as distortion and change of dimension and strain as the normalized or nondimensionalized measurement of distance of strain per total distance.

Thus, for strain (normalized change of dimension) to be uniform about the entire circumference of an apparatus 10, it is preferable that the thickness 16 as well as the top surface 17*a* to bottom surface 17*b* height 18 be uniform throughout. Even with a comparatively uniform thickness 16, and a uniform height 18, the circumference about the apparatus 10 may actually take on (be formed in) any shape.

Some examples are a star, a circle, a rectangle, an image shape, such as the head of a horse, the profile of an entire horse, the face of a cat, the entirety of a cat, the shape of a dog, the shape of any other animal pet, the shape of a particular vehicle style or design, and so forth. Thus, any of the conventional shapes of polygons, starts, circles, or images of live things or inanimate objects is a perspective profile to substitute for the "ring" 10 that is the apparatus 10 illustrated. One may thus consider the apparatus 10 to be defined by a wall 20 following any suitable shape and extending from an inner diameter 14 to an outer diameter 12 and having a height 18.

As a practical matter, a method of manufacture may involve extruding the shape of the apparatus 10. The extrusion constitutes the circumference thereof. Actually it includes both inner circumference and outer circumference. Generally, it is not necessarily a circular cross section. This may be done in a conventional extruder having a die shaped to the periphery or circumference, effectively, of the apparatus 10. Extrusion may involve any of several suitable methods, but may benefit from a vertical extrusion of an elastomeric polymer.

Elastomeric polymers may include compositions of silicone, natural rubber, synthetic rubber, and substantially any elastomeric polymer. Silicone and other "high temperature" polymers are those having temperatures greater than would normally be melted by exposure to the hot air of a commercial or domestic clothes dryer. Silicone compositions are used in bakeware exposed to temperatures over 400 degrees Fahrenheit.

Thus, any such elastomeric material having the proper mechanical characteristics may serve. It requires a suitable spring constant, elongation, maximum stress at rupture, and so forth. Those properties are understood in engineering. Any material suitable and durable may serve as the elastomeric polymer from which the apparatus 10 may be formed.

Following extrusion, individual instances of the product 10 or apparatus 10 may be sliced or cut across the shape (cross section) at a periodicity equal to the height 18. Thus, the height 18 may be adjusted to be comparatively shorter (thinner) or taller (thicker) as desired. There exist reasons to have the height 18 be comparatively low, even less than the wall thickness 16 in some instances. Total force required, ease of manipulation, and manufacturing are. In other instances it makes sense and provides a certain life expectancy and a different handling benefit of not "rolling up" to have the height 18 be comparatively longer than the wall thickness 16, and sometimes several times larger (several multiples thereof). However such a loop 10 requires or admits to a single loop with no twisting or doubling up.

The shape of the apparatus 10 necessarily will have a cross section. Indeed, the cross section of the wall 20 itself, as well as the cross section of the gap 21 or space 21 in the center thereof may take on any suitable shape. The number of shapes possible is a digit too high to begin to consider even a small fraction of the possibilities. One may refer to FIG. 2 for the shapes of several polygons. These polygonal shapes may be the cross sections 22 of the wall 20 itself along the section A-A of FIG. 1, as illustrated.

Figure 2:
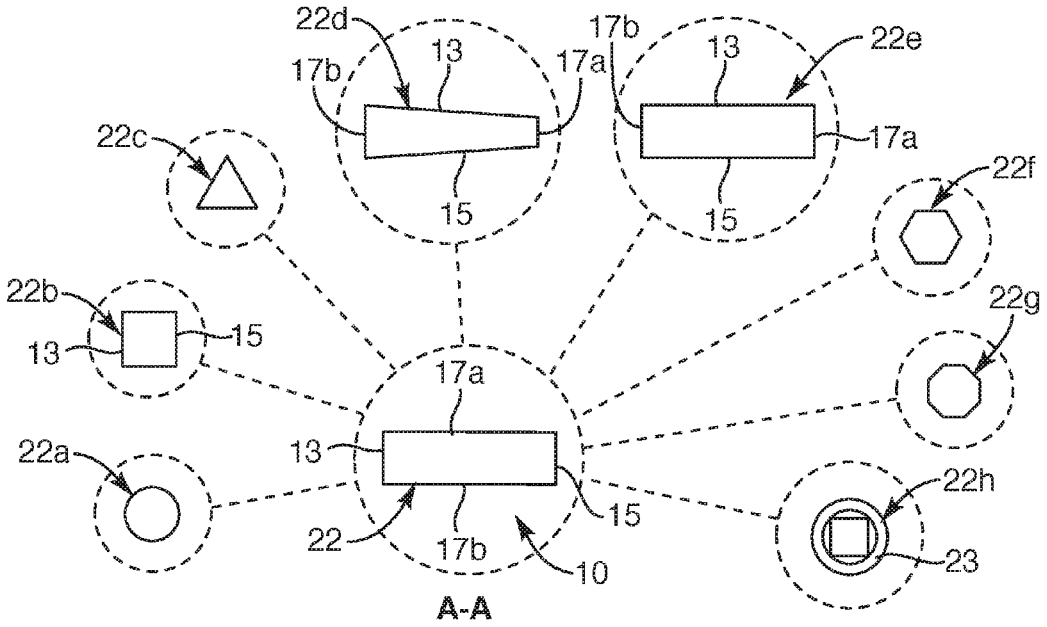
FIG. 2 is a cross-sectional view of various alternative cross sections of a loop apparatus in accordance with the invention.
Figure 3:
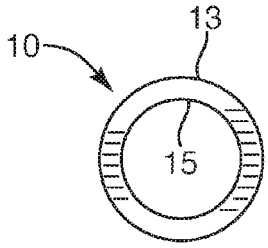
FIG. 3 is a top plan view of the article of FIG. 1.
Figure 4:
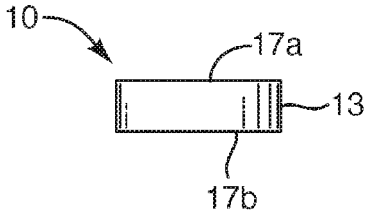
FIG. 4 is a front elevation view thereof, the rear elevation view being identical.
Figure 5:
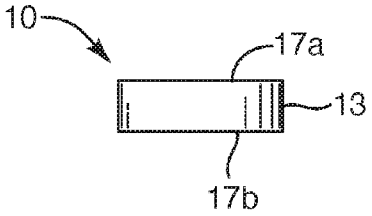
FIG. 5 is a right side elevation view thereof, which is identical to the left side elevation view thereof.
Figure 6:
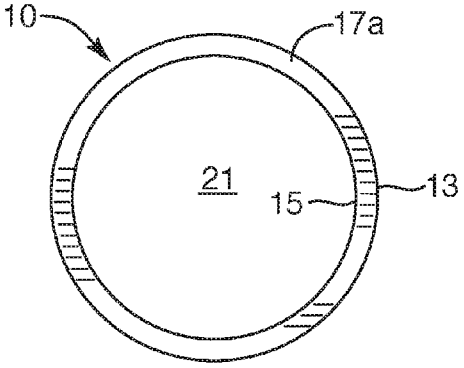
FIG. 6 is a top plan view of an alternative embodiment of a loop apparatus in accordance with the invention.
Figure 7:
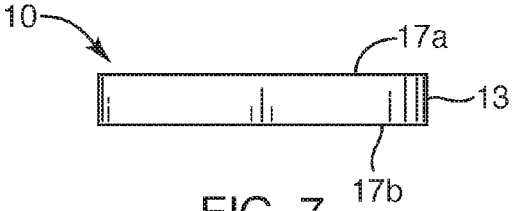
FIG. 7 is a front elevation view thereof, the rear elevation view being identical.
Figure 8:
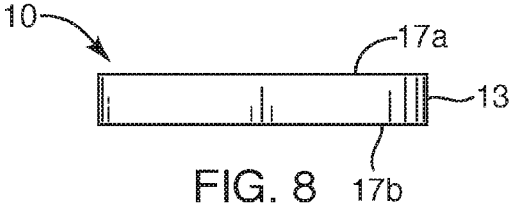
FIG. 8 is a right side elevation view thereof, the left side elevation view being identical thereto.
Figure 9:
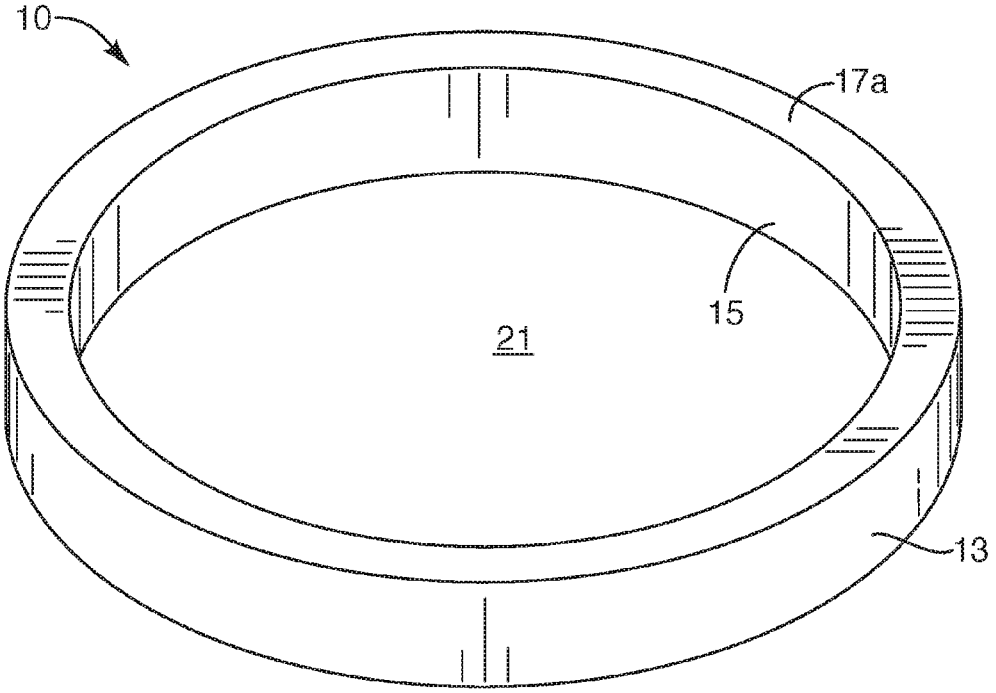
FIG. 9 is a perspective view thereof.

Nevertheless, each of these shapes of FIG. 2 also represents a possible shape for the interior surface 15 of the apparatus 10. Thus, with the wall thickness minimized and represented only by a line, any of those shapes and more may represent the perimeter and outer of an apparatus 10. Meanwhile, any of the other shapes of nature, plants, animals, houses, buildings, objects, tools, toys, vehicles, or the like may be the shape taken by the apparatus 10 when relaxed and unstretched.

A sheath 23 may be thought of as a decorative cover 23. For example, an alternative mechanism for manufacturing an apparatus 10 in accordance with the invention may involve extrusion of the solid polymer in a cross section 22 illustrated. For example, a circular cross section 22*a*, square cross section 22*b*, triangular cross section 22*c*, and trapezoidal cross section 22*d* may represent the wall 20 of the apparatus 10. Likewise, the rectangular cross section 22*e* is a parallelogram 22*e*. Meanwhile, the hexagon 22*f* and octagon 22*g* are not the limit. More sides are possible. Moreover, all of the shapes illustrated so far except a star are fully convex. They have no external concave surfaces. However, providing shapes of animals, plants, cars, other things, and so forth may involve the use of inside corners or concave corners on the outer perimeter of any of the walls 20 of an apparatus 10.

Thus, virtually any cross section 22 may be molded or extruded. Extrusion provides a continuous process. Moreover, extruding a shape 22 or cross section 22 may be done as a linear and continuous process. To form an actual ring 10, loop 10, or the like as an apparatus 10, one may bond cut ends of a stranded material to form the loop 10. There will be some uneven stress across the cross section too, as a result. However, with a sufficiently soft elastomeric polymer, such a construction technique is totally tractable.

A sheath 23 is most easily applied to an open strand of a linear material having a cross section 22. Thus, the decorative cover 23 may provide the entire decoration. In alternative embodiments, the decorative cover 23 may be augmented by having the ends thereof along with the ends of the internal wall 20 captured, bonded, cast, clipped, stapled, or otherwise captured in a grip or medallion that serves to close the loop 10, as well as provide a material by which to grasp the apparatus 10.

Figure 10:
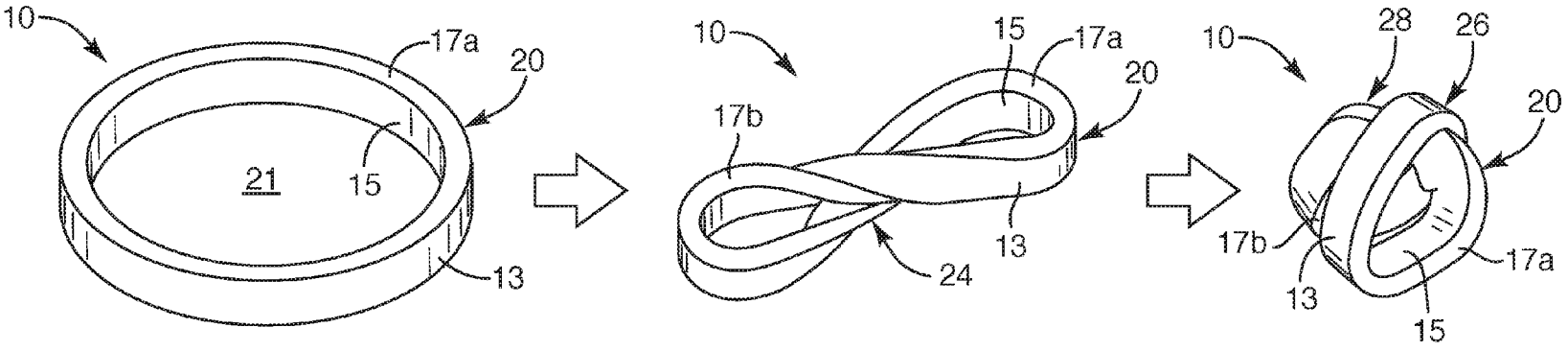
FIG. 10 is a prospective view of application of the apparatus in accordance with the invention, with the socks being absent for clarity.

Referring to FIG. 10, while continuing to refer generally to FIGS. 1 through 15, an apparatus 10 may be used as a single loop 10, or may be stretched and doubled back over itself. In the illustrated embodiment, the apparatus 10 may be placed around a pair of socks, drawn tight, and twisted as illustrated. The socks have been removed to illustrate the shape of the apparatus 10. Nevertheless, in the center configuration of the apparatus 10, stretching the apparatus 10 and twisting it to form two separate loops, serves to permit doubling up. Thus, ultimately, the apparatus 10 as in the configuration on the right demonstrates that the diameter has been diminished to about half. The overall stress or force has actually been doubled by two layers of the wall 20. The cross-over 24 or twist 24 is necessary in order to form one complete loop 10 around the socks or the object to be tied. Another loop 10 is then stretched larger to fit over the same object in order to provide the double loop 10 illustrated as the consequence of such an operation.

It is worth noting that the thickness 16 and height 18 of the wall 20 cooperate along with the overall inside diameter 14 to determine the ease with which the apparatus 10 may be stretched about socks a first, second, or both number of times. The smaller the opening 21 or gap 21 enclosed by the wall 20, the less space and therefore more constrictive hold will be imposed upon the grasped objects. The first loop 26 is typically made, and then all the slack or all the available tension drawn against it. Thereafter, a second loop 28 may follow the twist 24, and enclose once again the same object.

The size, meaning here the thickness 16, and height 18, which are necessarily affected by the shape 22 or cross section 22, will govern the stiffness or the resistance to stretching of the circumference or the diameters 12, 14 of the loop apparatus 10.

Figure 11:
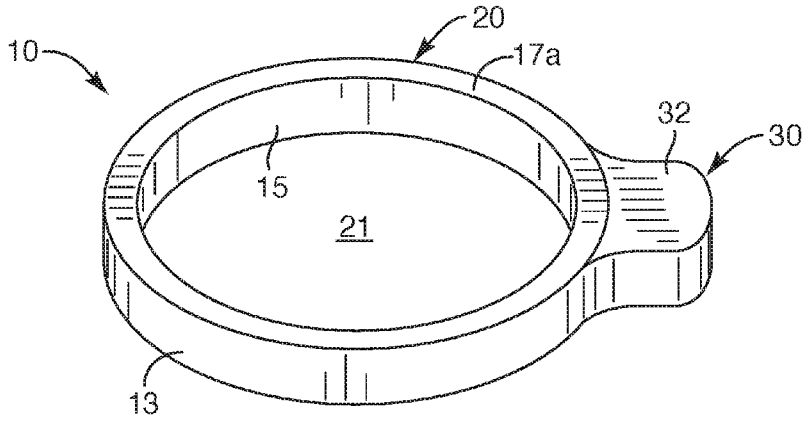
FIG. 11 is a perspective view of an alternative embodiment of a loop apparatus in accordance with the invention.
Figure 12:
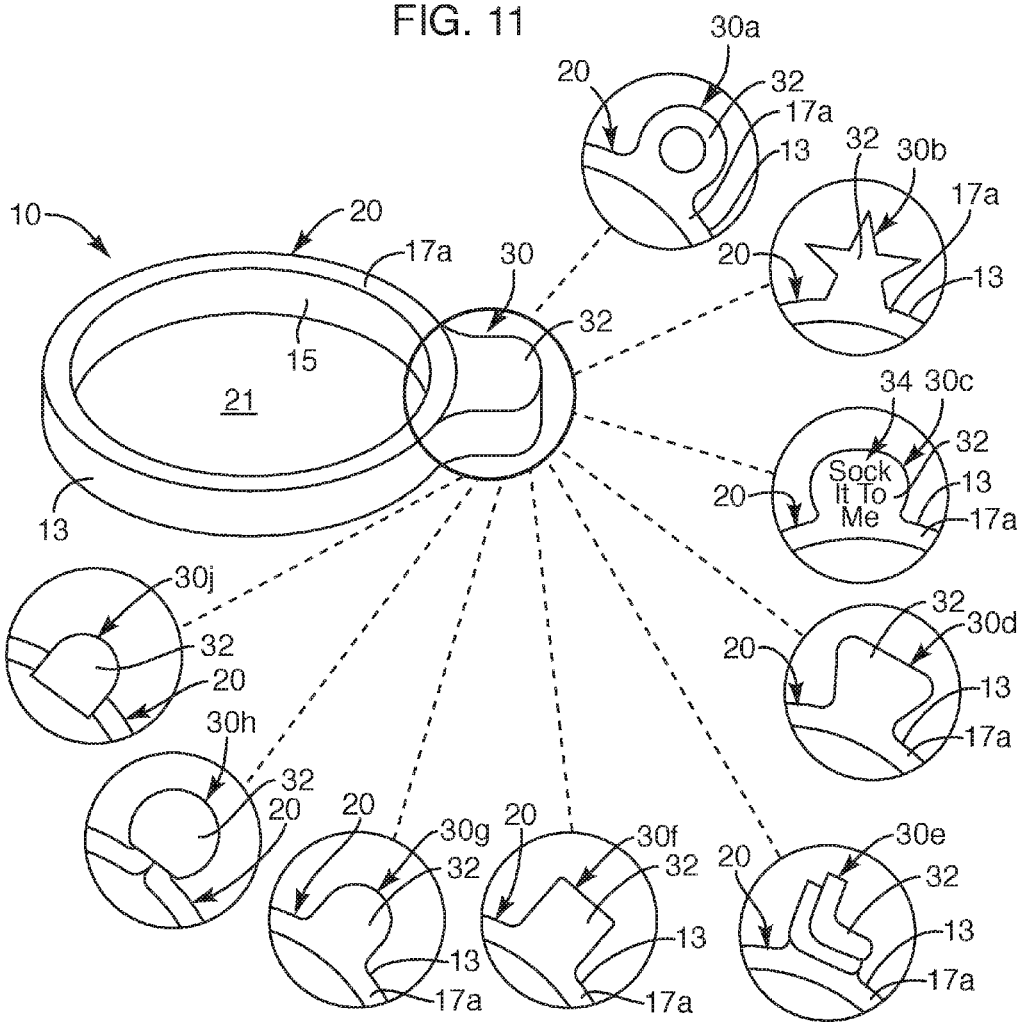
FIG. 12 is a perspective view of various alternative embodiments for the tab of FIG. 11.

Referring to FIGS. 11 and 12, while continuing to refer generally to FIGS. 1 through 15, a tab 30 may act as a grip 30 for grasping and stretching the size of the apparatus 10. For example, in applying the band 10 or apparatus 10 to an object or a bundle of objects to be gripped, one may insert fingers inside the space 21 encompassed by the wall 20. However, following a laundering of the grasped objects, the loop 10 or apparatus 10 may be difficult to grasp.

Depending on how much tension was put in the wall 20 (where tension is a stress or force per unit cross sectional area), it may be quite unsatisfactory to reach a fingernail or finger underneath or inside the inner diameter 14 to pull against the inside surface 15. Removing the apparatus 10 from a grasped bundle of articles may be done by rolling the apparatus 10 along the surface of the grasped objects.

It may be a more satisfactory mechanism to simply re-stretch one of the loops 26, 28 by grasping the tab 30, drawing it away from the grouped articles. Drawing enough slack may require moving it back and forth in a plane parallel to its upper and lower surfaces 17*a*, 17*b*. Once sufficient slack is drawn out of one of the loops 26, 28 the other loop 28, 26 may be drawn over the bundled articles. This effectively reduces multiple loops 26, 28 to a single loop 10.

In fact, depending on the particular dimensions it may be possible to loop more than just two loops 26, 28 in the article 10. Three, four, or more may be possible. Nevertheless, it has been found that one or two loops 26, 28 will serve well and provide a sufficiently robust and long lived product 10.

Referring to FIG. 12, while continuing to refer generally to FIGS. 1 through 15, the tab 30 may have any of a variety of shapes, and each may serve the purpose of decoration, information, or some other functionality. For example, the shape of the tab 30 may be somewhat arbitrarily defined. So long as it is of about sufficient surface area to be gripped well between the thumb and forefinger, it may serve its role to draw tension in the wall 20 of the apparatus 10.

Some of the shapes illustrated are, for example, a simple semicircle or circle. Beginning at the top configuration and proceeding clockwise, a circle blended into the wall 20 may provide a tab 30 with an aperture in the middle, or simply a material of a different color. Similarly, proceeding clockwise a star or other recognizable shape or symbol may be used as the tab 30. Meanwhile, an elongated or elliptical shape may provide space for a panel 32 receiving text 34.

In each of the shapes of tabs 30, the panel 32 serves as a frictional contact surface for the digits of a user. However, it may also serve the function of hosting text 34. The shape may altered, such as the next (trapezoidal) shape. This may accommodate specific text or provide room for larger text farther from the wall 20 and smaller text closer thereto. Moving more of the material farther away from the wall 20 may provide less influence on the loop 10 by the change of cross sectional area in the tab 30.

In other embodiments, the tab 30 may extend along a greater or lesser portion of the wall 20. One will note that the trapezoidal shape is rounded at the corners. This may provide benefit in manufacturing. It may also provide reduction of stress concentrations at changes in cross section, such as between the tab 30 and the wall 20. The rounded fillet area may provide additional life, and reduce the probability that such an interior corner might serve as a source of rupture for damage or failure over time.

Moving clockwise to the next inset, a shape of an object, such as the pair of socks shown in the same or different colors may be molded as the tab 30. These may be extruded in different colors, or may be stamped in different shapes or with a boundary thus shown. As illustrated, this cross section may be altered to meet some other image desired for commercial identification, user classification, or a suggestion of use.

Of course, different shapes, such as a rectangular tab 30 in the next inset, or a modified circular tab 30 may also be relied upon. Thus, the various tabs 30*a*, 30*b*, 30*c*, 30*d*, 30*e*, 30*f*, 30*g*, are but a sampling of the possible shapes that may be formed. In fact, in FIG. 11, a somewhat rounded corner on a rectangular object is but a variation of the somewhat elongated but circular shape of the tab 30*g*. Thus, any of a variety of shapes that are suitable for gripping, may extend a sufficient distance away from the wall 20 to support a good stiff tug or pull to stretch the ring 10 open. Any may well serve as a decorative, functional, or both types of elements for the tabs 30.

Figure 13:
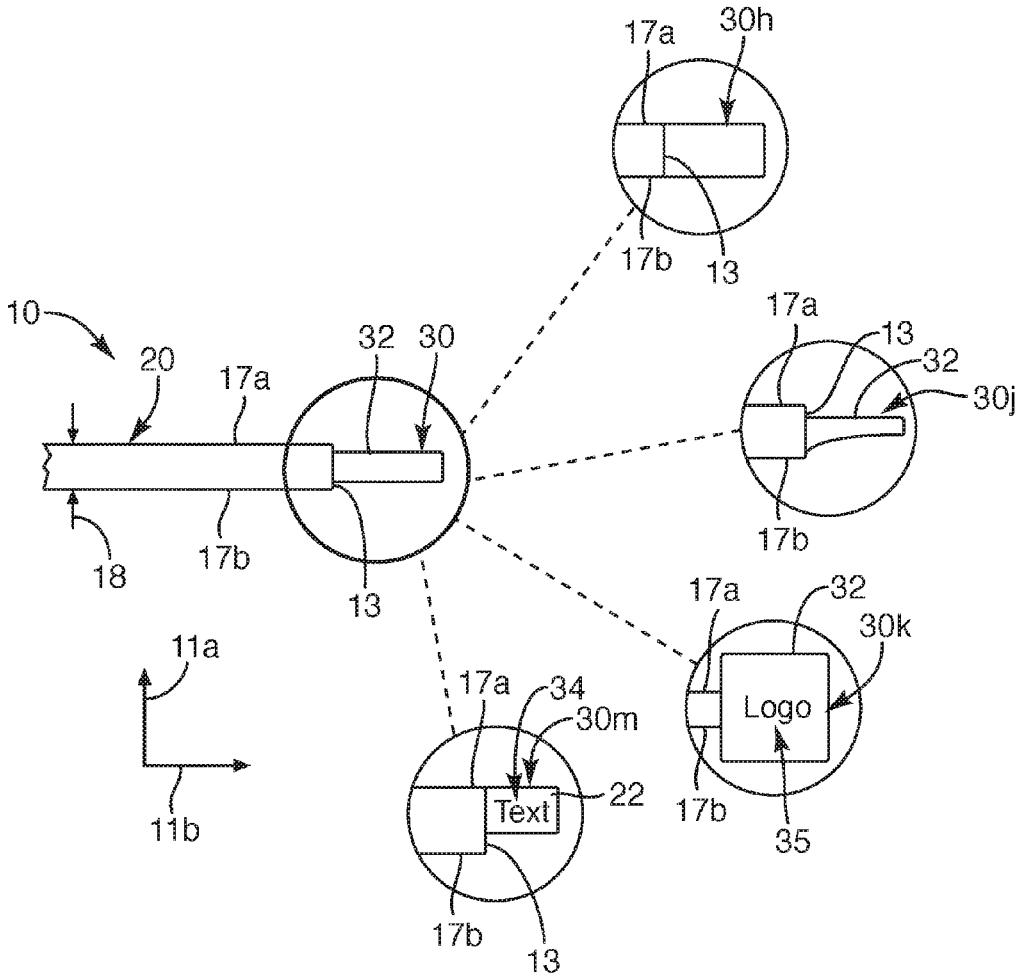
FIG. 13 a left side elevation view of an alternative embodiment of a loop apparatus in accordance with the invention, illustrating by exploded inset views, and various alternative cross sections.

Referring to FIG. 13, while continuing to refer generally to FIGS. 1 through 15, the tab 30 need not be shaped in any particular way or limited to any particular shape in the orthogonal direction. That is, the top plan view illustrated in the tabs 30*a* through 30*g* may have a constant thickness, or it may vary.

For example, beginning clockwise at the top, a tab 30 may have a rectangular aspect or rectangular shape that is either thinner, thicker, or the same thickness as the height 18 of the wall 20 of the loop 10. In fact, any of the shapes of FIG. 13 may actually have uniform thickness in the direction into the page. Alternatively, any of the shapes of FIG. 13 may also be applied to any of the shapes in FIG. 12. Since each is a cross section in a direction orthogonal to the other, they may be used in any combination.

Thus, the profile of the tab 30*h* is simply extending at exactly the same thickness 18 of the main loop 10. The shape of the tab 30*j* extends at a varying thickness, tapering as it extends away from the apparatus 10. Similarly, the tab 30*k* provides for an image 36 such as a logo 36. Just as a surface parallel to the top surface 17*a* of the loop 10 may have a message, a surface orthogonal thereto may have a logo 36, text 34, or other emblem.

Meanwhile, the dimensions of the tab 30*m* illustrate that the panel 32 may include text 34 that is much smaller. Of course, a matter of design choice and utility of the tab 30 may be overridden by design characterizations or desires, communication of information, and so forth. Thus, in general, the shapes in a direction axially 11*a*, radially 11*b* or circumferentially 11*c* may include all possibilities.

For example, an axis 11*d* extending radially but orthogonal to both the axial direction 11*a*, and another radial direction 11*b*, may define a three-dimensional, rectangular set of coordinates. However, as a practical matter, in the illustrated embodiments, a circular cross section of the shape may be defined by an axial direction 11*a* and a radial direction 11*b*, which may proceed in any direction orthogonal to the axial direction 11*a*, as will be sufficient to define a position. Nevertheless, in a circumferential direction 11*c*, it will typically be necessary to define a point by at least three axes out of the group of axes 11*a*, 11*b*, 11*c*, 11*d*.

Figure 14:
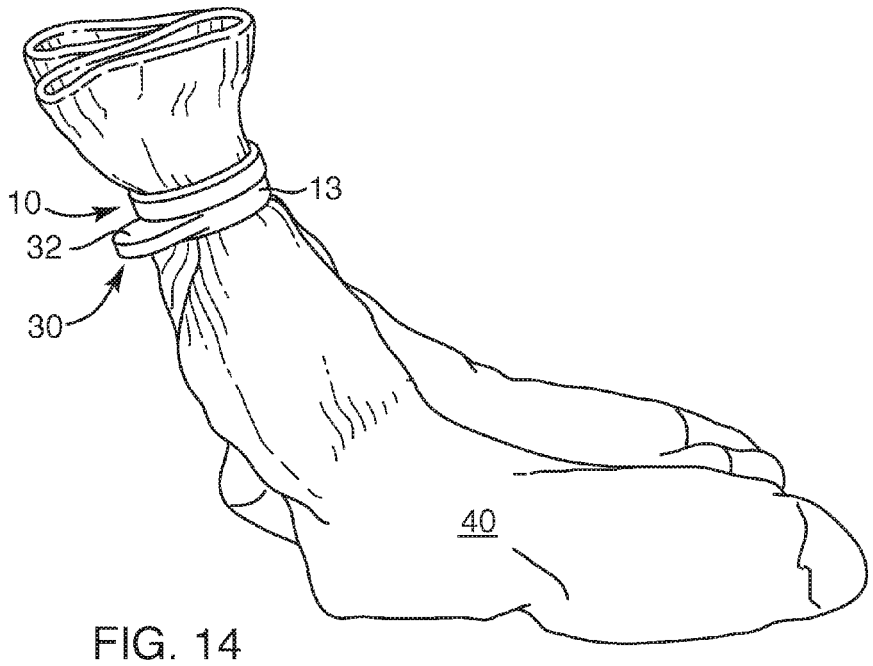
FIG. 14 is a perspective view of one embodiment of a loop apparatus in accordance with the invention, being drawn around the pair of socks, twisted and drawn around the socks again to form a double loop or a double turn around the socks.
Figure 15:
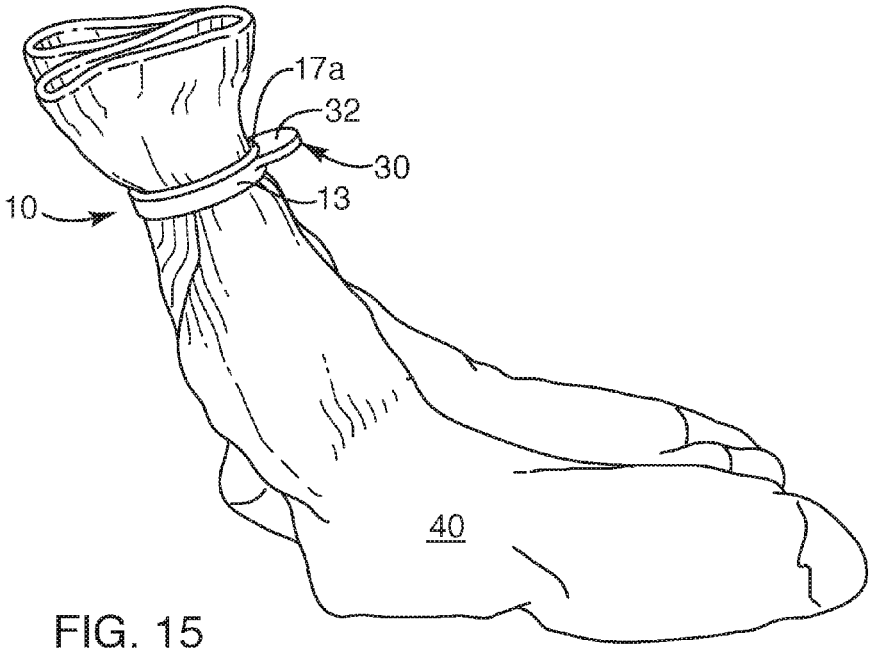
FIG. 15 is a perspective view of a pair of socks in which a loop apparatus in accordance with the invention has been looped around a portion of the socks a single time to bind them together.

Referring to FIGS. 14 and 15, while continuing to refer generally to FIGS. 1 through 15, a pair of socks 40 may be grasped with multiple turns as illustrated in FIG. 14, or as a single loop about a pair or multiple pairs. Typically, the thickness 16, height 18, and material are all matters of design choice and engineering of molds, dies, and the like. Likewise, an outer diameter 12, inner diameter 14, and the overall constitution of film in the polymer selected may all be matters of personal choice, design choice, or engineering expediency.

Thus, it may be possible to use two or more turns in an apparatus 10 about one or more pairs of socks 40. Similarly, the single loop 10 may be sufficient. However, it has been found that more turns with higher tension become more difficult to remove as tension equalizes during the rustle and bustle of the washing and drying processes. Thus, an apparatus 10 is adaptable to being used on one pair of socks 40 with a single loop 10, or providing multiple turns 26, 28 with a single pair 40.

The size of any of the dimensions may be selected to provide a comfort level. It may even be provided in multiple sets of dimensions in order to provide a tough pull or more forceful requirement, a more modest or medium amount of pull, or a comparatively easy pull. Of course these gradations may be color coded, may be marked, such as with numbers or emblems on the tab 30, and so forth.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of laundry comprising:

obtaining an apparatus comprising a closed loop having a shape of the loop in a resting configuration, a cross sectional area and shape orthogonal to a circumference thereof, and a restrained shape conformal to an object contained therewith;

restraining a first portion of the loop against movement thereof;

extending, by elastic deformation of the circumference of the loop, a second portion of the loop by drawing it away from the first portion;

placing within the loop a plurality of the objects to be secured together between the first, restrained, portion and the second portion drawn away therefrom; and releasing the first and second portions of the loop to grip the plurality of objects.

2. The method of claim 1, further comprising twisting the loop prior to the releasing, and passing the plurality of objects through the portion of the loop most distant from the plurality of objects around the objects a second time.

3. The method of claim 1, wherein the apparatus further comprises a tab, and the method further comprises grasping the tab to apply tension to deform the loop and release the plurality of objects within the loop.

4. The method of claim 1, further comprising passing the plurality of objects as a group, bound together by the loop, into a washing cycle of a washing machine.

5. The method of claim 4, further comprising passing the plurality of objects through a cycle of a drying machine directly from the washing thereof.

6. The method of claim 4, further comprising running the plurality of objects continually secured together by the loop through a drying process.

7. The method of claim 6, further comprising removing the loop from the plurality of objects.

8. The method of claim 7, further comprising dividing the plurality of objects into pairs.

9. The method of claim 4, further comprising removing the loop from the plurality of objects.

10. The method of claim 9, further comprising dividing the plurality of objects into pairs.

* * * * *